United States Patent [19]

Sackenreuter et al.

[11] Patent Number: 4,993,310

[45] Date of Patent: Feb. 19, 1991

[54] SEALING FOR THE DIFFERENTIAL PRESSURE PISTON-FUEL CHAMBER SYSTEMS OF FIREARMS

[75] Inventors: Hans Sackenreuter, Ruckersdorf; Gerhard Onderka, Nuremberg, both of Fed. Rep. of Germany

[73] Assignee: Diehl GmbH & Co., Nuremberg, Fed. Rep. of Germany

[21] Appl. No.: 532,509

[22] Filed: Sep. 6, 1983

[51] Int. Cl.[5] ..... F41F 1/04

[52] U.S. Cl. ..... 89/7; 277/53

[58] Field of Search ..... 89/7, 8; 277/53

[56] References Cited

U.S. PATENT DOCUMENTS

| | | | |
|---|---|---|---|
| 2,018,372 | 10/1935 | Mason | 277/53 X |
| 2,291,243 | 7/1942 | Levy | 277/53 X |
| 3,138,990 | 6/1964 | Jukes et al. | 89/7 |
| 4,033,224 | 7/1977 | Holtrop | 89/7 |
| 4,050,348 | 9/1977 | Graham | 89/7 |
| 4,099,445 | 7/1978 | Singelmann et al. | 89/7 |
| 4,100,836 | 7/1978 | Hofmann | 89/8 X |
| 4,269,107 | 5/1981 | Campbell | 89/7 |
| 4,281,582 | 8/1981 | Jaqua | 89/7 |
| 4,304,410 | 12/1981 | Erickson et al. | 279/53 |
| 4,341,147 | 7/1982 | Mayer | 89/7 |

*Primary Examiner*—David H. Brown

*Attorney, Agent, or Firm*—Scully, Scott, Murphy & Presser

[57] ABSTRACT

A sealing arrangement for differential pressure piston-combustion chamber systems, which serve for the generation of propellant gases for barreled firearms from liquid, in particular hypergolic propellant components (hypergolic diergoles), and which are constructed with a differential pressure piston or ram located in the weapon housing, which is axially movable in coaxial relationship with the weapon barrel, and which includes a support piston projecting into the hollow shaft of the differential pressure piston, as well as propellant infeed and propellant discharge passageways. The combustion chamber which connects to the weapon barrel widens conically at a relatively flat angle, and in which the head of the differential pressure piston (injector), which is provided with overflow passageways and nozzles, has its external contour correlated with the cone of the combustion chamber. Hereby, the conically-shaped outer wall or shell surface of the injector can incorporate annular recesses, grooves or the like. The lower surface of these recesses or grooves, for reasons of simplifying the manufacturing technology and production, can be arranged in parallel with the longitudinal axis of the differential pressure piston. Within the cylindrical injector shaft there can be inserted a support piston, and between the support piston and the inner wall or shell of the injector shaft, as well as between the outer wall or shell of the injector shaft and the housing, there can also be, respectively, provided a labyrinth seal.

5 Claims, 2 Drawing Sheets

FIG. 1
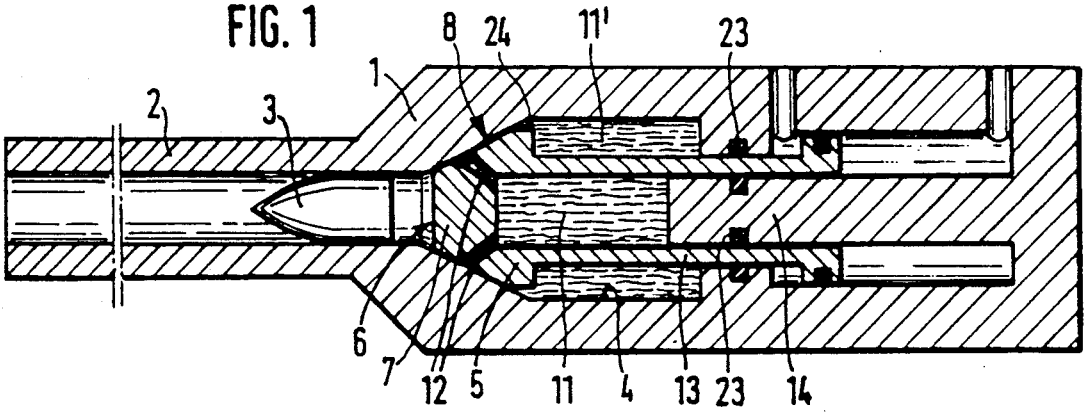
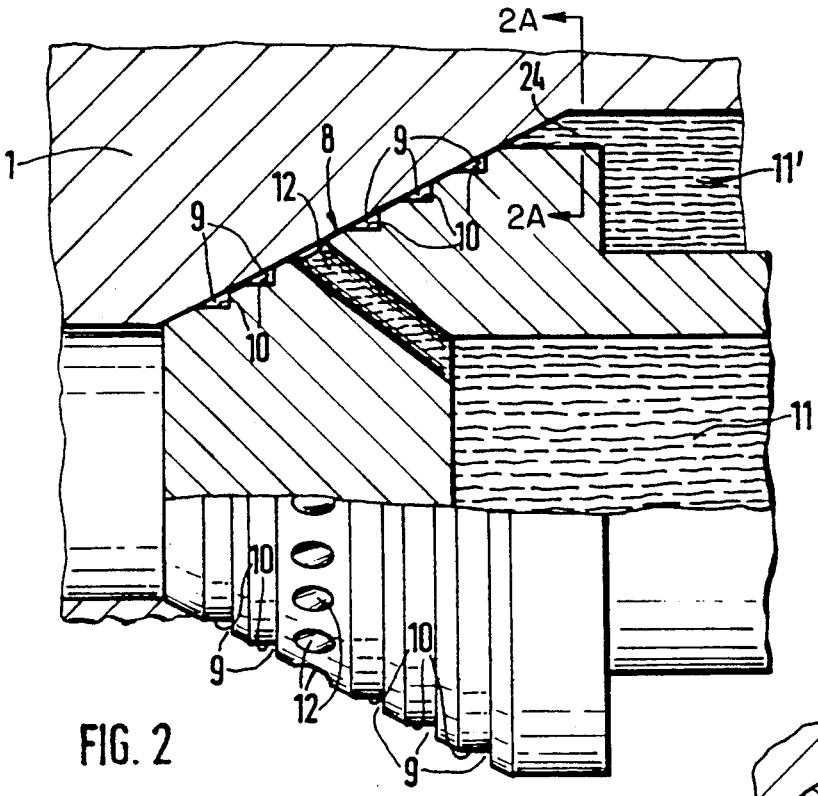
FIG. 2
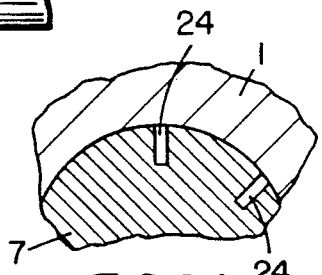
FIG.2A

SEALING FOR THE DIFFERENTIAL PRESSURE PISTON-FUEL CHAMBER SYSTEMS OF FIREARMS

BACKGROUND OF THE INVENTION

1. Field of the Invention

The present invention relates to a sealing arrangement for differential pressure piston-combustion chamber systems, which serve for the generation of propellant gases for barreled firearms from liquid, in particular hypergolic propellant components (hypergolic diergoles), and which are constructed with a differential pressure piston or ram located in the weapon housing, which is axially movable in coaxial relationship with the weapon barrel, and which includes a support piston projecting into the hollow shaft of the differential pressure piston, as well as propellant infeed and propellant discharge passageways.

Concepts are well known with regard to barreled firearms and, especially, automatic cannons with the generation of propellant gases from hypergolic liquid propellants. Such concepts are contemplated for a median firing cadence of about 800 shots/minute and for calibers of between 20 mm and 40 mm. Through investigations there could be ascertained that the firearms which are equipped for operation through hypergolic diergoles afford at least the same power output as do firearms of the usual type with propellant charge powders. Theoretical power output computations have indicated that at the same maximum gas pressures and the same weapon barrel length, in firearms with hypergolic liquid propellants there can be achieved higher muzzle velocities for the projectiles, wherein there must be further positively taken into consideration, that the heating up and the erosion of the weapon barrel are lower than those for barreled weapons employing propellant charge powders.

The hypergolic liquid propellant is a two-component propellant which consists of a fuel and an oxidizer. The fuel ignites hypergolically with the oxidizer, meaning, without the use of external energy, and possesses detonating time delays of less than five milliseconds after the commenced admixing and contacting, which provide interesting combinations for barreled weapons. Such propellant combinations are known from the rocket technology. Preferably employed as an oxidizer are white or red-smoking nitric acid or dinitrous tetroxide. By means of such an oxidizer, different fuels are mixed with varying degrees of hypergolicity and toxicity. The essential advantages of firearms or automatic or machine cannons with hypergolic liquid propellants in comparison with those employing propellant charge powders, are the lack of a cartridge for the receipt of the propellant charge, the lack of a detonating device, and the liquid aggregate condition of the propellant. Inasmuch as each component is stored and transported separately from the others, and each individual component per se is not explosive, there is extensively reduced the danger of any injury to the weapon carrier.

2. Discussion of the Prior Art

Numerous patent publications are known which illustrate firearms with a hypergolic diergole.

In the firearm pursuant to German Patent 17 28 074, the propellant injection is effectuated by means of a regeneratively driven differential pressure piston or ram. The injection nozzles include spring-loaded nonreturn valves. The start of the injection and the detonation is undertaken by an auxiliary injection arrangement, whose actuation is effected shortly prior to the forward impact of the differential pressure piston.

In the firearm pursuant to German Patent 17 28 077, the propellant injection is also effected through a regeneratively driven differential pressure piston, while the injection nozzles are equipped with a plate-and-slide valve which is arranged ahead thereof and which is remotely-controlled. The propellant aspiration is effected through the remotely-actuated forward motion of the differential pressure piston, and the start of the injection as well as the detonation are effected through the remotely-actuated return movement of the differential pressure piston.

The firearm pursuant to U.S. Pat. No. 2,981,153 possesses a propellant injection system formed by a plurality of regeneratively-operated differential pressure pistons which are not synchronized and which necessitate a precise correlation of the nozzles. The radial arrangement of the differential pressure pistons facilitates the provision of a small combustion chamber volume and a short coaxial projectile infeed. The injection nozzles are provided with needle valves which are pneumatically actuated.

German Patent 24 27 139 discloses a differential pressure piston-combustion chamber system for the generation of propellant gases from hypergolic fuel components for firearms which incorporates a guide cylinder for the differential pressure piston and injection pumps which are driven by the latter.

In all of the above-mentioned firearms pursuant to the current state of the technology, there are employed differential-pressure pistons or rams which are arranged so as to be axially movable, and are as a consequence subject to sealing problems at their head ends as well as at their shaft ends. By means of the gas pressure, the individual propellant components are pressed back, and enter the minute spaces between the components which are longitudinally movable relative to each other.

SUMMARY OF THE INVENTION

Accordingly, it is an object of the present invention to provide a differential pressure piston-combustion chamber system of the above-mentioned type, in which the head end of the differential pressure piston is sealed through simple means with respect to the combustion chamber or the weapon barrel during the filling phase of the propellant components until the commencement of the injection, as well as the longitudinally movable shaft with respect to the rearward portions of the combustion chamber.

The foregoing object is inventively achieved in that the combustion chamber which connects to the weapon barrel widens conically at a relatively flat angle, and in which the head of the differential pressure piston (injector), which is provided with overflow passageways and nozzles, has its external contour correlated with the cone of the combustion chamber. Hereby, the conically-shaped outer wall or shell surface of the injector can incorporate annular recesses, grooves or the like. The lower surface of these recesses or grooves, for reasons of simplifying the manufacturing technology and production, can be arranged in parallel with the longitudinal axis of the differential pressure piston.

The surfaces of the combustion chamber and injector which are correlated with each other at a flat-angled cone, are adapted for sealing in a particularly advantageous and simple manner. The flat cone enlarges the overall contact surface or sealing surface, and concurrently allows for a limited centering of the injector. By means of the annular recesses there are produced a plurality of annular sealing surfaces so that, on the one hand, imprecisions in manufacturing of the surface of the injector and the combustion chamber are effectively almost completely eliminated and, on the other hand, there is facilitated the formation of annular volumes or spaces which must be initially filled before any significant quantities of liquid will enter into the subsequent annular space.

In accordance with a further embodiment of the invention, the conical outer wall or shell surface of the injector can extend up to an external diameter which has its cylindrically extending portion correspond with the bore of the weapon housing, and overflow passageway can be arranged distributed about the circumference of the cylindrical portion of the injector in the shape of longitudinal grooves. The nozzles can connect from the metering chamber in the injector in a circumferentially distributed manner into the conical portion of the outer wall or shell surface. The thusly constructed injector will, on the one hand, facilitate the positioning of the metering chamber for the fuel which sprayed from there through the overflow passageways into the combustion chamber upstream of the injector. Concurrently, from the inwardly located metering chamber of the injector, the second propellant component, the oxidizer, is similarly injected into the combustion chamber. An exchange of the metering chamber is thus also within the scope of the invention, as well as the selection of the suitable size.

Within the cylindrical injector shaft there can be inserted a support piston, and between the support piston and the inner wall or shell of the injector shaft, as well as between the outer wall or shell of the injector shaft and the housing, there can also be, respectively, provided a labyrinth seal.

BRIEF DESCRIPTION OF THE DRAWINGS

Reference may now be had to the following detailed description of an exemplary embodiment of the invention, taken in conjunction with the accompanying drawings; in which:

FIG. 1 illustrates a longitudinal section through a schematically illustrated barreled firearm in its position prior to firing a projectile;

FIG. 2 illustrates, in a partial section, the head of the differential pressure piston (injector);

DETAILED DESCRIPTION

Figure 3:
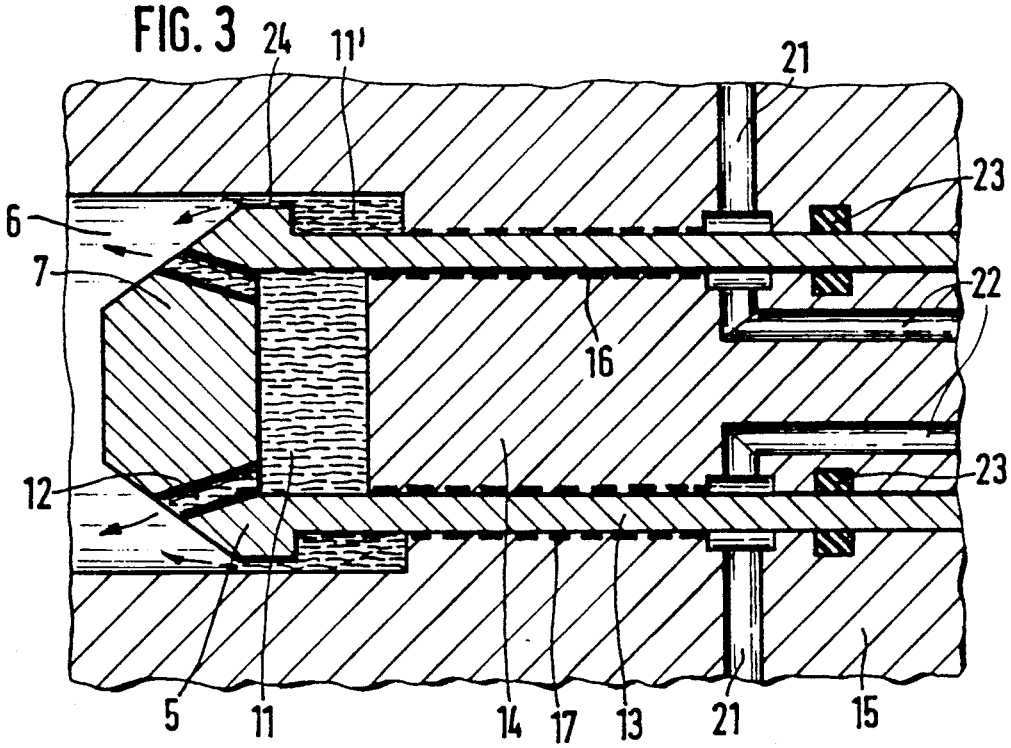
FIG. 3 schematically illustrates the labyrinth sealing for the components which are axially movable relative to each other, shown in section.

On a firearm housing 1, within a bore 4 which extends coaxially with the bore axis of the firearm barrel 2, there is arranged the differential pressure piston 5 so as to be axially movable therein. The forward portion of the bore 4 which is open towards the firearm barrel 2 forms the combustion chamber 6, which extending from the firearm barrel 2, conically widens at a relatively flat angle. The head 7 of the differential pressure piston 5 (injector) has in its external contour conformed with the cone of the combustion chamber 6, so as to produce an overall large sealing surface between the two components. A conical shell surface 8 of the injector 7 is provided with annularly extending recesses, ridges, grooves 9 (FIG. 2) or the like, whose lower surface 10, due to technological production reasons, are presently oriented in parallel with the longitudinal axis of the differential pressure piston 5. By means of the recesses or annular grooves 9, on the shell surface 8 of the injector 7 there are produced a series of segmental or staggered, annularly extending sealing surfaces which come into contact with the cone of the combustion chamber 6. Located downstream of the injector 7 is the annular or ring-shaped metering chamber 11' for the fuel, which is connected through overflow passages 24 with combustion chamber 6.

Arranged within the injector 7 is the metering chamber 11 for the oxidizer. From the metering chamber 11, nozzles 12 extend through the injector 7 and connect into the conical shell surface 8 of the latter. Inserted within the injector shaft 13 is a support piston 14.

A housing 15 is constructed to centrally extend about the injector shaft 13. In order to maintain at a low level the return flow of the oxidizer during the high pressure phase from the metering chamber 11 into the rearward region of the differential pressure piston 5, between the support piston 14 and the injector shaft 13 there is located a labyrinth seal 16 in the form of ring-shaped or threadlike extending recesses in the outer wall or shell of the support piston 14. The housing 15 encompasses the shell surface of the injector shaft 13, and also incorporates a labyrinth seal 17 in thread-like or ring-shaped extending recesses. Due to the foregoing, during the high-pressure phase, the fuel which is located in the metering chamber 11' will wander rearwardly only in a minute amount when a gas pressure builds up the forward combustion chamber 6.

Figure 4:
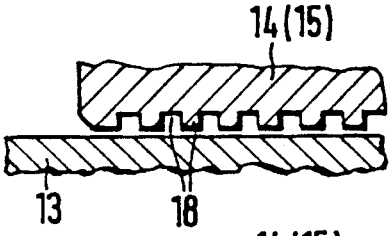
FIG. 4 illustrates a sectional fragmentary view of a labyrinth seal according to FIG. 3.
Figure 5:
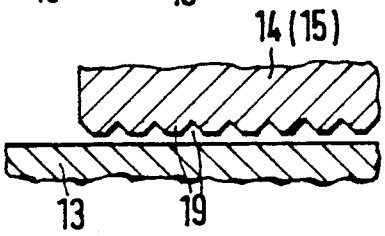
FIG. 5 is a sectional view similar to that of FIG. 4 showing a modified embodiment of a labyrinth seal.
Figure 6:
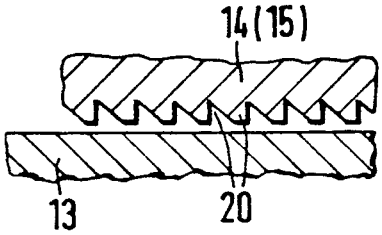
FIG. 6 is a third embodiment of a labyrinth seal.

Through the formation of annular spaces there is extensively prevented any return flow of fluids between longitudinally movable components. The ring-shaped spaces fill up gradually, so that the through-flow of fluids into the subsequent annular space is considerably reduced through the effect of turbulence. The recesses of the labyrinth seals can be constructed, in accordance with FIGS. 4, 5 and 6, either rectangularly 18, circularly or conically shaped, or in a sawtooth configuration 20.

Reference numerals 21 and 22 designate the discharge passageways for the fuel and the oxidizer, into which there can enter the leakage fluids as soon as they egress from the labyrinth sealing. Closing annular sealings 23, 23' are located axially downstream of the discharge passageways 21, 22.

What is claimed is:

1. In a sealing arrangement for differential pressure piston-combustion chamber systems which serve for the generation of propellant gases for barreled firearms from liquid, and particularly hypergolic propellant components; including a differential pressure piston axially movable within a firearm housing and being coaxial with the barrel of said firearm; and a support piston being arranged within a hollow shaft of the differential pressure piston, including propellant infeed and propellant discharge passageways; the improvement comprising: a combustion chamber connected with the firearm barrel, said combustion chamber widening conically at a flat angle; the head of the differential pressure piston forming an injector provided with overflow passageways and nozzles and having an external contour correlated with the cone of said combustion chamber, and the conical outer surface of the injector including annularly arranged recesses or grooves.

2. Differential pressure piston, combustion chamber system as claimed in claim 1, wherein the lower surface of the recesses, grooves or the like extends in parallel with the longitudinal axis of the differential pressure piston.

3. Differential pressure piston-combustion chamber system as claimed in claim 1, wherein the conical outer surface of the injector extends to an outer diameter conforming to the cylindrically extending portion of the bore of the firearm housing; and overflow passageways being distributed circumferentially about the cylindrical portion of the injector, said passageways being in the shape of longitudinal grooves.

4. Differential pressure piston-combustion chamber system as claimed in claim 1, wherein said nozzles connect from a metering chamber in said injector circumferentially distributed into the conical portion of the outer wall surface.

5. Differential pressure piston-combustion chamber system as claimed in claim 1, comprising a support piston being arranged within a cylindrical injector shaft of said injector, and labyrinth seals being located between, respectively, the support piston and the inner wall of the ejector shaft, and between the outer wall of the injector shaft and the housing component of said firearm.

* * * * *